US010117498B2

(12) United States Patent
Schrepf

(10) Patent No.: US 10,117,498 B2
(45) Date of Patent: Nov. 6, 2018

(54) RESERVOIR FOR A VISCOUS OR LIQUID COSMETIC PRODUCT AND AN ASSEMBLY COMPRISING A COSMETIC APPLICATOR

(71) Applicant: Albea Cosmetics America, INC, Morristown, TN (US)

(72) Inventor: Volker Schrepf, East Islip, NY (US)

(73) Assignee: ALBEA COSMETICS AMERICA, INC, Morristown, TN (US)

( * ) Notice: Subject to any disclaimer, the term of this patent is extended or adjusted under 35 U.S.C. 154(b) by 0 days.

(21) Appl. No.: 15/360,863

(22) Filed: Nov. 23, 2016

(65) Prior Publication Data

US 2018/0140075 A1 May 24, 2018

(51) Int. Cl.

| | |
|---|---|
| ***A46B 17/08*** | (2006.01) |
| ***A45D 40/26*** | (2006.01) |
| ***A45D 34/04*** | (2006.01) |
| ***A46B 3/00*** | (2006.01) |
| ***A46B 3/18*** | (2006.01) |
| ***A46B 9/02*** | (2006.01) |

(52) U.S. Cl.

CPC ..... *A45D 40/267* (2013.01); *A45D 34/046* (2013.01); *A46B 3/005* (2013.01); *A46B 3/18* (2013.01); *A46B 9/021* (2013.01); *A46B 2200/1053* (2013.01)

(58) Field of Classification Search

CPC ..... A45D 34/046; A45D 40/267

USPC ..... 401/122

See application file for complete search history.

(56) References Cited

U.S. PATENT DOCUMENTS

| | | | | |
|---|---|---|---|---|
| 3,870,186 | A | 3/1975 | Reinhard | |
| 5,803,638 | A | 9/1998 | Gueret | |
| 6,033,142 | A * | 3/2000 | Gueret | A45D 34/046 401/122 |
| 7,278,798 | B1 * | 10/2007 | Kearney | A45D 40/267 401/121 |
| 7,967,519 | B2 * | 6/2011 | Gueret | A45D 40/267 401/121 |
| 2005/0129452 | A1 * | 6/2005 | Bosman | A45D 40/262 401/122 |

* cited by examiner

*Primary Examiner* — Jennifer C Chiang

(74) *Attorney, Agent, or Firm* — Steven M. Greenberg, Esq.; Shutts & Bowen LLP

(57) ABSTRACT

A reservoir for a cosmetic viscous or liquid product. The reservoir includes a body and a wiper, the reservoir being designed so that a cosmetic applicator, which includes a core and bristles mounted on the core, can be moved from the inside of the reservoir to the outside of the reservoir through the wiper. The wiper includes a tubular sleeve and a multiplicity of ribs disposed on the tubular sleeve. The ribs longitudinally extend along a longitudinal direction parallel to a longitudinal direction of the sleeve, and are tapered in a radial direction from the inner wall of the sleeve toward the inside of the sleeve. Moreover, the ribs are arranged on an inner wall of the sleeve and guide the bristles of the cosmetic applicator during its passage through the wiper.

10 Claims, 3 Drawing Sheets

RESERVOIR FOR A VISCOUS OR LIQUID COSMETIC PRODUCT AND AN ASSEMBLY COMPRISING A COSMETIC APPLICATOR

BACKGROUND OF THE INVENTION

Field of the Invention

The present invention relates to a reservoir for liquid or viscous product and an assembly comprising a cosmetic applicator.

Description of the Related Art

Cosmetic assemblies usually comprise a reservoir to receive a viscous or liquid cosmetic product and an applicator to apply the cosmetic product to the eyelashes. The reservoirs are composed of a reservoir to stock the mascara and a wiper to remove the excess of mascara from the applicator when the applicator is moved from the inside of the reservoir to the outside of the reservoir. However, it has been observed that the distribution of mascara on the applicator can be quite irregular which poses strong issues for a user, for instance when using brushes made of fibers and twisted wires. Also, the passage of the applicator through the wiper tends to modify the orientation of the bristles which, here again, does not provide the applicator with a homogenous distribution of the cosmetic product.

BRIEF SUMMARY OF THE INVENTION

Embodiments of the present invention address deficiencies of the art in respect to mascara applicators and provide a novel and non-obvious reservoir for a cosmetic viscous or liquid product. In an embodiment of the invention, the reservoir includes a body and a wiper, the reservoir being designed so that a cosmetic applicator which includes a core and bristles mounted on the core can be moved from the inside of the reservoir to the outside of the reservoir through the wiper. The wiper includes a tubular sleeve and ribs designed on the tubular sleeve, with the sleeve extending longitudinally along a longitudinal direction, and the ribs being arranged on an inner wall of the sleeve and designed to guide the bristles of the cosmetic applicator during its passage through the wiper. In this regard, the ribs longitudinally extend along a longitudinal direction parallel to the longitudinal direction of the sleeve, and are tapered in a radial direction from the inner wall of the sleeve toward the inside of the sleeve.

In different aspects of the embodiment, which can be taken together or separately:

- the ribs are designed to redistribute the cosmetic product along the applicator,
- the wiper comprises at least six ribs, any two successive ribs on the inner wall of the sleeve are equally spaced apart from one another,
- the ribs have a height $h_{Ribs}$ measured along a radial direction of the sleeve, the sleeve has an inner diameter $D_{InnerSleeve}$, free ends of the bristles forming an envelope, the envelope having a greatest transversal dimension $D_{EnvMax}$, the assembly being designed so that $D_{InnerSleeve}-2*h_{Ribs}\leq D_{EnvMax}$,
- the ribs have a sensibly triangular cross section, the cross section being orthogonal to the longitudinal direction of the ribs,
- a width of the ribs is constant along the length of the ribs, the width $W_{Ribs}$ being measured in a direction orthogonal to the longitudinal direction of the ribs and orthogonal to the height $h_{Ribs}$ of the ribs,
- the ribs are designed so that the width $W_{Ribs}$ of the ribs at a free end of the ribs is thin enough for the bristles to be pushed to either one side or the other of each rib when the applicator goes through the wiper,
- the sleeve and the ribs are made of the same material.

As well, it is of note that embodiments of the invention also provide an assembly that includes a reservoir as described above and a cosmetic applicator designed to be used with the reservoir.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein.

DETAILED DESCRIPTION OF THE INVENTION

Figure 1:
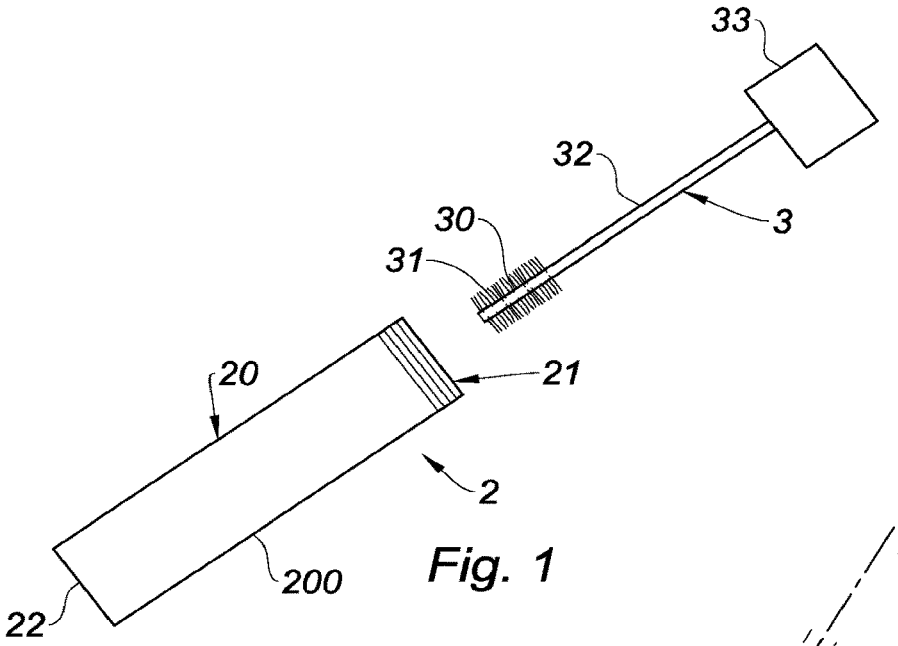
FIG. 1 is side view of a cosmetic applicator according to one aspect of the invention.
Figure 1A:
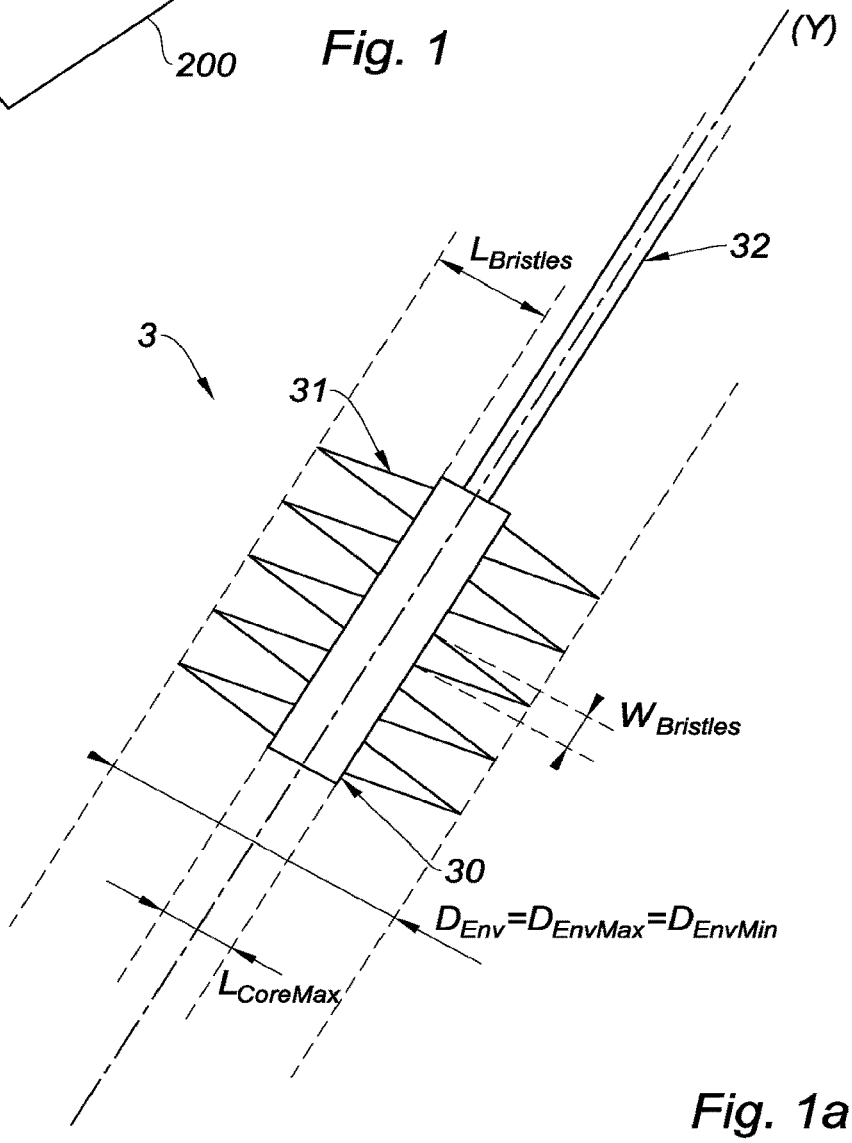
FIG. 1*a* is a side view of a core of the cosmetic applicator illustrated at FIG. 1.

As illustrated at FIG. 1, the invention relates to an assembly comprising a cosmetic applicator 3 and a reservoir 2. The cosmetic applicator 3 can be designed for the application of a cosmetic product on the eyelashes. As can be seen in FIG. 1, the cosmetic applicator 3 includes holding structure 33, a rod 32 and applying structure. The rod 32 includes an upper end and a lower end. The rod 32 extends from its upper end to its lower end in a main extension direction. The rod 32 is attached to the holding structure 33 at its upper end and to the applying structure at its lower end.

Here, the applying structure includes a core 30 and bristles 31 attached to the core 30. The core 30 extends along a main longitudinal extension direction of the core 30, also referred to as the main axis Y of the core 30. Advantageously, the bristles 31 extend in a radial direction from the core 30. In other words, the bristles 31 extend from the core 30 and in a direction orthogonal to the core 30. Specifically, the rod 32 is connected to the core 30 at the lower end of the rod 32.

The cosmetic applicator 3 can be plastic molded with bristles 31 directly molded on the core. Diversely, the core 30 can be a twisted wire holding the bristles 31. In that case, the core 30 comprises, for example, two wires twisted together or two parts of the same wire twisted together. In that case, the bristles 31 are fibers. Here, the core 30 has a transversal dimension which can be measured orthogonally to the main axis Y of the core 30. The transversal dimension of the core 30 is to be understood as the greatest dimension of each cross section of the core 30. As a consequence, if the core is a right circular cylinder then the section and the transversal dimension of the core 30 are constant along the core 30. Conversely, if the core 30 is not a right circular cylinder then the transversal dimension of the core 30 can vary along the length of the core 30.

The core 30 of the cosmetic applicator 3 has a greatest transversal dimension referred to as $D_{CoreMax}$. The greatest transversal dimension $D_{CoreMax}$ of the core 30 is measured orthogonally to the main axis Y of the core 30 and is equal to a maximum of the transversal dimension of the core 30 along the core 30.

Each one of the bristles 31 includes a proximal end and a distal end. Specifically, each bristle 31 extends along a main longitudinal direction of the bristle 31 from one end to the other. The proximal end of each bristle 31 can be merged with the core 30 and/or can be a base of the bristle 31. The distal ends of the bristles 31 are free ends. The bristles have a transversal dimension $W_{Bristles}$ measured orthogonally to their main longitudinal direction. The bristles 31 also have a length $L_{Bristles}$ which is measured along the main longitudinal direction of the bristles 31 from the proximal end of the bristles 31 to their free end.

The free ends of the bristles 31 form altogether an envelope of the cosmetic applicator 3. The envelope longitudinally extends along a main axis of the envelope. The envelope longitudinally extends from a first longitudinal extremity to a second longitudinal extremity. The main axis of the envelope coincides here with the main axis Y of the core 30.

The envelope has a transversal dimension $D_{Env}$ which can be measured orthogonally to the main axis of the envelope. The transversal dimension of the envelope is to be understood as the greatest dimension of each cross section of the envelope, each cross section of the envelope being perpendicular to the main axis of the envelope.

In particular, the envelope of the cosmetic applicator 3 has a maximum transversal dimension $D_{EnvMax}$ and a minimum transversal dimension $D_{EnvMin}$. The maximum transversal dimension $D_{EnvMax}$ of the envelope is measured orthogonally to the main axis of the envelope and is equal to a maximum of the transversal dimension $D_{Env}$ of the envelope along the envelope. The minimum transversal dimension $D_{EnvMin}$ of the envelope is measured orthogonally to the main axis of the envelope and is equal to a minimum of the transversal dimension $D_{Env}$ of the envelope along the envelope. Specifically here, the minimum transversal dimension $D_{EnvMin}$ of the envelope can be measured at both longitudinal extremities of the envelope. The maximum transversal direction $D_{EnvMax}$ can be measured halfway between the two longitudinal extremities of the envelope. Alternatively, the maximum transversal dimension $D_{EnvMax}$ equals the minimum transversal dimension $D_{EnvMin}$.

The reservoir 2 includes a body 20 and a wiper 1. The body 20 forms a cavity and is intended to receive the cosmetic product. In other words, the body 20 is a recipient for the cosmetic product which can be liquid or viscous. Here, the body 20 is hollow and cylindrical. It extends from a lower end to an upper end along a main extension direction of the body 20. The body 20 includes a bottom 22 at its lower end and an opening 21 at its upper end. The body 20 also includes a sidewall 200 which extends from the bottom 22 to the opening 21 along the main extension direction of the body 20.

Figure 2:
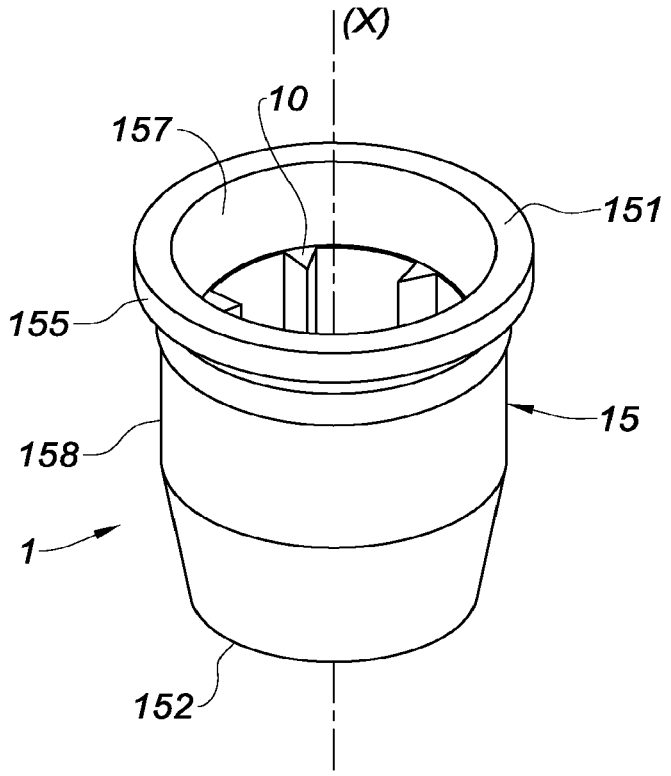
FIG. 2 is a view in perspective of a wiper according to one aspect of the invention.
Figure 3:
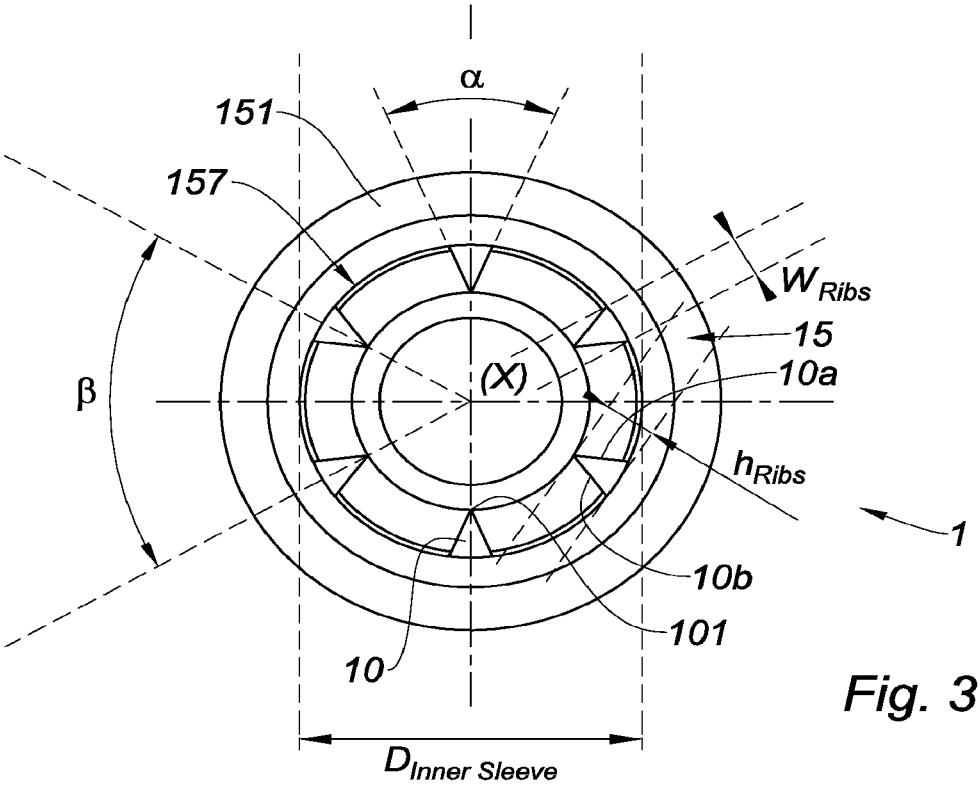
FIG. 3 is a cross section of the wiper of FIG. 2.
Figure 4:
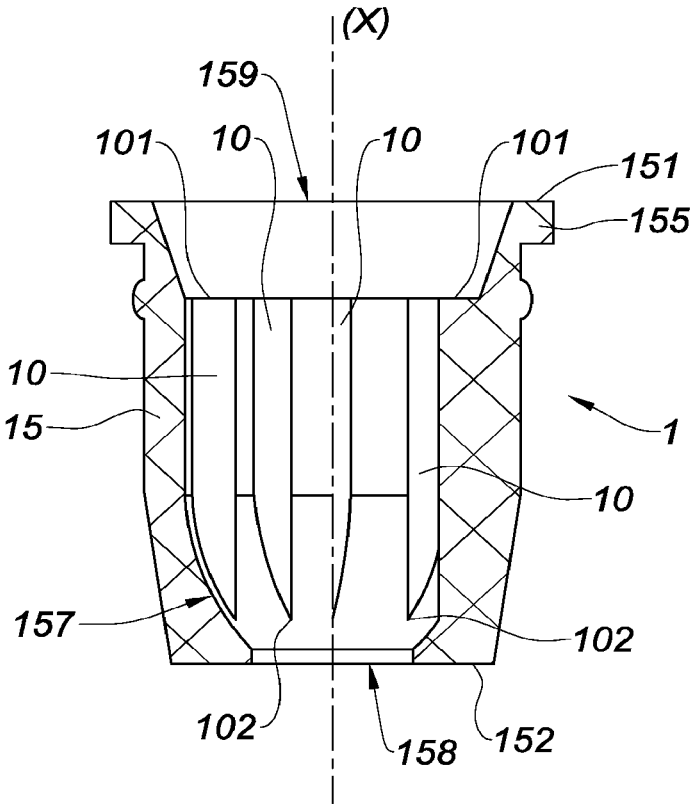
FIG. 4 is a side view of half of a wiper of FIG. 2.

The wiper 1, illustrated at FIGS. 2, 3 and 4, is designed to be arranged inside the body 20 of the reservoir 2, at the upper end of the body 20. The wiper 1 is conceived to prevent an excess of cosmetic product on the cosmetic applicator 3 when the cosmetic applicator 3 is moved out from the inside of the reservoir 2 to the outside of the reservoir 2. The wiper 1 includes a tubular sleeve 15 and ribs 10 on an inner periphery the tubular sleeve 10. For instance, the wiper can be made of low density polyethylene (LDPE), thermoplastic elastomers and/or nitrile rubbers.

The sleeve 15 longitudinally extends along a longitudinal direction, also referred to as the main axis X of the sleeve 15, from a lower end 152 to an upper end 151. The wiper 1 is formed so that when the cosmetic applicator 3 is taken out from the inside of the reservoir 2, the cosmetic applicator 3 goes first through the lower end 152 of the sleeve 15 and second through the upper end 151 of the sleeve 15.

The sleeve 15 has an essentially tubular shape. The sleeve 15 has an annular cross section from its upper end 151 to its lower end 152. The sleeve 15 has a circular shoulder 155 at its upper end 151 and a narrowing part at its lower end 152. The sleeve 15 has an inner wall 157 and an outer wall 158 which approximately extend in parallel with each other. The sleeve 15 has an inner diameter $D_{InnerSleeve}$ which is equal to the diameter of its inner wall 157. The inner diameter $D_{InnerSleeve}$ of the sleeve 15 is variable and progressively decreases when moving from the upper end 151 of the sleeve 15 to the lower end 152 of the sleeve 15. For instance, $D_{InnerSleeve}$ has a value of 9.1 mm when measured at the upper end 151 of the sleeve 15.

Here, the wiper 1 has six ribs 10. The ribs 10 are designed to help align the bristles 31 of the cosmetic applicator 3 during the passage of the cosmetic applicator 3 through the wiper 1. The ribs 10 protrude from the inner wall 157 of the sleeve 15. The ribs 10 longitudinally extend from an upper end 101 to a lower end 102 in a longitudinal direction of extension which is essentially parallel to the longitudinal direction of the sleeve 15. Specifically, the ribs 10 extend along a straight line and are essentially parallel to each other. For instance, $D_{InnerSleeve}$ has a value of 7.6 mm when measured at the upper ends 151 of the ribs 10.

The ribs 10 are tapered in a radial direction of the sleeve 15 from the inner wall 157 of the sleeve 15 toward the inside of the sleeve 15. In other words, each rib 10 has a width $W_{Ribs}$, said width $W_{Ribs}$ being measured orthogonally to the longitudinal direction of the sleeve 15 and orthogonally to the radial direction of the sleeve 15, which decreases when moving along a radial direction of the sleeve 15 from the inner wall 157 of the sleeve 15 toward the main axis X of the sleeve 15.

Here, as can be seen at FIG. 3, each rib 10 has a cross section that approximately has a triangular shape, said cross section being orthogonal to the longitudinal direction of the rib 10. More, each rib 10 has two planar faces 10*a*, 10*b* that extend from the lower end 102 of the rib 10 to the upper end 101 of the rib 10 in a direction parallel to the longitudinal direction of the rib 10. The two planar faces 10*a*, 10*b* of each rib 10 are separated from each other by an angular gap. The two planar faces 10*a*, 10*b* of each rib 10 form with each other an angle $\alpha$ inferior or equal to 45°, here equal to 45°.

Here, the ribs 10 are staggered around the inner wall 157 of the sleeve 15. Specifically, the ribs 10 are angularly spaced from each other with a constant angle $\beta$. The angle $\beta$ is a 60° angle. Each rib 10 has a height $h_{ribs}$. The height $h_{ribs}$ of the rib 10 is a dimension of the ribs 10 measured in a radial direction of the sleeve 15 and from the inner wall 157 of the sleeve 15 to a free end 101 of the ribs 10. As can be seen at FIG. 3, the free end 101 of the rib 10 coincides, in a cross section of the wiper 1, with one of the three summits of the triangle section of the rib 10, said summit being the one not merged with the inner wall 157 of the sleeve 15. In other words, the height $h_{ribs}$ is equal to the height of the triangle section of each rib 10. Here, as can be seen at FIG. 4, the height $h_{ribs}$ of each rib 10 decreases from the upper end 101 of the rib 10 to its lower end 102. For instance, $h_{Ribs}$ has a value of 2.3 mm when measured at the upper end 101 of the ribs 10. Here, $h_{Ribs}$ has a value of 0 when measured at the lower end 101 of the ribs 10.

Here, the assembly is designed so that the ribs 10 drive the bristles 31 along a direction parallel to the main axis Y of the core 30 of the cosmetic applicator 3 when the applicator 3 is taken out from the inside of the reservoir 2. Also, the assembly is designed so that when the applying means of the applicator 3 go through the wiper 1, the bristles 31 are easily put in contact with the ribs 10. It should be noted that the assembly is designed so that bristles 31 from essentially all around the core 30 can be put in contact simultaneously with the ribs 10 when the cosmetic applicator is taken out from the inside of the reservoir 2. Specifically here, the assembly is designed so that $D_{InnerSleeve}-2*h_{Ribs}<D_{EnvMax}$ or $D_{InnerSleeve}-2*h_{Ribs}<D_{EnvMin}$. This way, bristles 31 all along the core 30 are guided by the ribs 10 wiper 1.

It has been observed that the shape and positions of the ribs 30, along with the proportions of the assembly, help to enhance the distribution of cosmetic product on the applying structure of the cosmetic applicator 3 and therefore help to enhance the application of the cosmetic product on part of a user's body.

The ribs 10 are designed so that the bristles 31 can come in contact with either one of the plane faces 10*a*, 10*b* of each rib 10 when the applicator is taken out from the inside of the reservoir. Also, the free ends 101 of the ribs 10 are designed thin enough so that the bristles 31 are not crushed onto the free ends 101 of the ribs 10. For example, the width $W_{Ribs}$ of the ribs 10 at the free end 101 of the ribs 10 is inferior or essentially equal to the transversal dimension $W_{Bristles}$ of the bristles 31. Alternatively, $W_{Ribs}\leq\mu*W_{Bristles}$, where μ is chosen, for example, among the following values: 10; 8, 6; 4; 2; 1; 0.5. Of note, the assembly is designed so that $h_{Ribs}/L_{Bristles}\geq\Omega$ with Ω chosen among, for example, the following values: 1, 0.8, 0.5, 0.2 or 0.1.

Finally, the terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

Having thus described the invention of the present application in detail and by reference to embodiments thereof, it will be apparent that modifications and variations are possible without departing from the scope of the invention defined in the appended claims as follows:

I claim:

1. A reservoir for a cosmetic viscous or liquid product, the reservoir comprising:

a body and a wiper arranged inside the body along a common longitudinal axis, the wiper comprising a tubular sleeve defining an interior portion, and a multiplicity of ribs disposed on an interior periphery of the tubular sleeve and longitudinally extending along a longitudinal direction parallel to the common longitudinal axis, the ribs being tapered in a radial direction from the interior periphery of the tubular sleeve toward the longitudinal axis;

the reservoir being adapted to receive a cosmetic applicator comprising a core and bristles mounted on the core, the cosmetic applicator when received by the reservoir moving from an inside portion of the reservoir to outside the reservoir through the interior portion of the tubular sleeve of the wiper, the ribs of the tubular sleeve guiding the bristles of the cosmetic applicator during the movement by the cosmetic applicator through the tubular sleeve of the wiper, wherein the width of the ribs at a free end of the ribs is less than or equal to a transversal dimension of the bristles and therefore thin enough for the bristles to be pushed to either one side or the other of each rib when the cosmetic applicator moves through the wiper.

2. The reservoir according to claim 1, wherein the ribs during the movement of the cosmetic applicator through the tubular sleeve of the wiper redistribute cosmetic product along the cosmetic applicator.

3. The reservoir according to claim 1, wherein the wiper comprises at least six ribs.

4. The reservoir according to claim 1, wherein any two successive ribs on the inner periphery of the sleeve are equally spaced apart from one another.

5. The reservoir according to claim 1, wherein:

the ribs have a height hRibs measured along a radial direction of the tubular sleeve, the tubular sleeve has an inner diameter DInnerSleeve, and free ends of the bristles form an envelope, the envelope having a greatest transversal dimension DEnvMax, the assembly being designed so that DInnerSleeve−2*hRibs≤DEnvMax.

6. The reservoir according to claim 1, wherein the ribs have a sensibly triangular cross section, the cross section being orthogonal to the longitudinal direction of the ribs.

7. The reservoir according to claim 1, wherein a width WRibs of each of the ribs remains constant along an entire length of each of the ribs, the width WRibs being measured in a direction orthogonal to the longitudinal direction of the ribs and orthogonal to the height hRibs of the ribs.

8. The reservoir according to claim 1, wherein the width WRibs of the ribs at a free end of the ribs is WRibs≤μ*WBristles, where μ is chosen as any of 10, 8, 6, 4, 2, 1 and 0.5 and therefore thin enough for the bristles to be pushed to either one side or the other of each rib when the cosmetic applicator moves through the wiper.

9. The reservoir according to claim 1, wherein the tubular sleeve and the ribs are made of a common material.

10. An assembly comprising:

a reservoir and a cosmetic applicator designed to be used with the reservoir;

the cosmetic applicator comprising a core and bristles mounted on the core;

the reservoir comprising:

a body and a wiper arranged inside the body along a common longitudinal axis, the wiper comprising a tubular sleeve defining an interior portion, and a multiplicity of ribs disposed on an interior periphery of the tubular sleeve and longitudinally extending along a longitudinal direction parallel to the common longitudinal axis, the ribs being tapered in a radial direction from the interior periphery of the tubular sleeve toward the longitudinal axis;

the reservoir being adapted to receive the cosmetic applicator such that when the cosmetic applicator is received by the reservoir, the cosmetic applicator moves from an inside portion of the reservoir to outside the reservoir through the inside portion of the tubular sleeve of the wiper, with the ribs of the tubular sleeve guiding the bristles of the cosmetic applicator during the movement by the cosmetic applicator through the tubular sleeve of the wiper, wherein the width of the ribs at a free end of the ribs is less than or equal to a transversal dimension of the bristles and therefore thin enough for the bristles to be pushed to either one side or the other of each rib when the cosmetic applicator moves through the wiper.

* * * * *